US005425525A

United States Patent [19]

Cevasco

[11] Patent Number: 5,425,525

[45] Date of Patent: Jun. 20, 1995

[54] ANTI-THEFT DEVICE

[75] Inventor: Robert E. Cevasco, Norwich, N.Y.

[73] Assignee: Vantine Studios, Hamilton, N.Y.

[21] Appl. No.: 197,322

[22] Filed: Feb. 16, 1994

[51] Int. Cl.[6] ..... F16M 13/00

[52] U.S. Cl. ..... 248/551; 248/552; 248/553; 70/58; 40/152.1

[58] Field of Search ..... 248/203, 466, 475.1, 248/222.4, 489, 497, 551, 553, 552, 222.2; 40/152.1, 617; 211/8; 70/14, 57, 58, 59, 159, 163, 164; 109/23, 42, 50–52

[56] References Cited

U.S. PATENT DOCUMENTS

| | | | |
|---|---|---|---|
| 603,544 | 5/1898 | Wagenblast | 211/8 |
| 1,429,091 | 9/1922 | Oppman . | |
| 1,580,207 | 4/1926 | Kibbe | 248/552 |
| 1,634,884 | 7/1927 | Peer | 248/551 |
| 1,676,707 | 7/1928 | Peer | 248/551 |
| 1,745,574 | 2/1930 | Hoegger | 248/475.1 |
| 3,284,940 | 11/1966 | Putman | 40/152.1 |
| 3,612,469 | 10/1971 | Dennis | 248/475 |
| 3,695,568 | 10/1972 | Hogrebe | 248/223 |
| 3,709,456 | 1/1973 | Pietsch | 248/475 |
| 3,753,359 | 8/1973 | Frey | 70/19 |
| 3,912,216 | 10/1975 | Gano | 248/551 |
| 3,952,436 | 4/1976 | Kuhnke | 40/152.1 |
| 4,030,628 | 6/1977 | Hippert, Jr. | 220/85 |
| 4,074,888 | 2/1978 | Garner | 248/475 |
| 4,095,361 | 6/1978 | Ledenican | 40/152 |
| 4,170,334 | 10/1979 | Villanueva | 248/553 |
| 4,385,744 | 5/1983 | Sherman et al. | 248/551 |
| 4,499,679 | 2/1985 | Sherman | 40/152.1 |
| 4,502,306 | 3/1985 | Scammacca | 70/159 |
| 4,572,470 | 2/1986 | Siffert | 248/551 |
| 4,723,880 | 2/1988 | Stumpf, Jr. | 410/143 |
| 4,738,428 | 4/1988 | Themistos et al. | 248/551 |
| 4,788,840 | 12/1988 | Wilson, Jr. | 70/164 |
| 4,893,777 | 1/1990 | Gassaway | 248/551 |
| 4,903,934 | 2/1990 | Fremstad | 248/551 |
| 5,082,233 | 1/1992 | Ayers et al. | 248/553 |
| 5,109,683 | 5/1992 | Cartwright | 70/14 |
| 5,189,822 | 3/1993 | Schmanski et al. | 40/611 |

*Primary Examiner*—Ramon O. Ramirez
*Assistant Examiner*—Catherine S. Collins
*Attorney, Agent, or Firm*—Venable, Baetjer, Howard & Civiletti

[57] ABSTRACT

The invention relates to a two member mounting device wherein one member of the device is mounted to a wall, the second member is attached to the back of a picture frame or plaque. The two members inter-engage one another such that a pad lock maybe attached to the device to prevent the two members from being separated, thus securing the picture frame to the wall.

3 Claims, 4 Drawing Sheets

ANTI-THEFT DEVICE

BACKGROUND OF THE INVENTION

1. Field of the Invention

The present invention relates to a security device for use with picture frames, plaques, memorabilia commonly mounted to a wall of a house, hotel or museum.

2. Description of the Related Art

Works of art, photographs, awards and memorabilia are commonly displayed in a manner that allows a large number of people to view the materials. Typically, an article on display hangs freely on a hook mounted on a wall surface. Theft and vandalism of such displayed articles is an ever increasing problem.

There are a large number of security systems and devices currently known for deterring the theft of picture frames and the art work within the frame. One such device is disclosed in Sherman U.S. Pat. No. 4,385,744 et al. The Sherman et al. patent discloses the use of securing brackets attached to a wall. A second set of brackets attach to a picture frame. The brackets on the picture frame are designed to engage the brackets on the wall to hold the picture frame against the wall. A lever attached to one of the wall mounted brackets acts to prevent removal of the picture frame from the wall. When the picture frame is mounted to the wall, the lever is hidden from view. The lever is moved by a separate tool which is inserted between the wall and picture frame, engages the lever and moves the lever to release the picture frame. A serious drawback to the Sherman et al. device is the use of a tool which may be lost. Further, a clever thief may use an implement such as a bent coat hanger or the like to move the lever, thus releasing the picture frame from the wall. Also, by gently rocking a secured frame, a retained lip of the frame channel can be used as a camming surface to move a retained latch pivot member into a release position thus permitting removal of the picture frame.

In spite of the clever intentions of the inventors of many frame securing devices to hide the securing mechanisms, a clever thief can usually find a way to circumvent a hidden security device.

SUMMARY OF THE INVENTION

In one embodiment of the present invention, two bracket members are used to secure a frame to a wall. The first bracket member is mountable to a wall and has a "T" shaped configuration. The upper portion of the "T" of the first member has a generally planar lower portion that, when mounted to the wall, lies flush against it. The upper edge of the "T" portion is inclined upwardly and outwardly away from the wall. The lower portion of the "T" member extends downwardly and lies flat against the wall. The lower end of the "T" member includes an outwardly extending flange. The flange extends outwardly from the wall to allow the bottom edge of a picture frame to rest upon the flange. The flange is formed with an aperture.

The second member of the invention, in one embodiment of the present invention, also has a "T" shaped configuration and is attached to a picture frame. The upper edge of the second member is formed with an outwardly and downwardly extending flange that is configured to engage the upper edge of the first bracket member. The lower end of the second bracket is formed with an eyelet. When the second bracket is attached to the first bracket, the eyelet extends through the aperture in the lower end of the first bracket. A padlock may then be installed in the eyelet thus securing the two brackets together.

DESCRIPTION OF THE DRAWINGS

These and other objects and features of the invention will become more apparent upon an examination of the following description taken in conjunction with the accompanying drawings wherein.

DESCRIPTION OF THE PREFERRED EMBODIMENT

Figure 1:
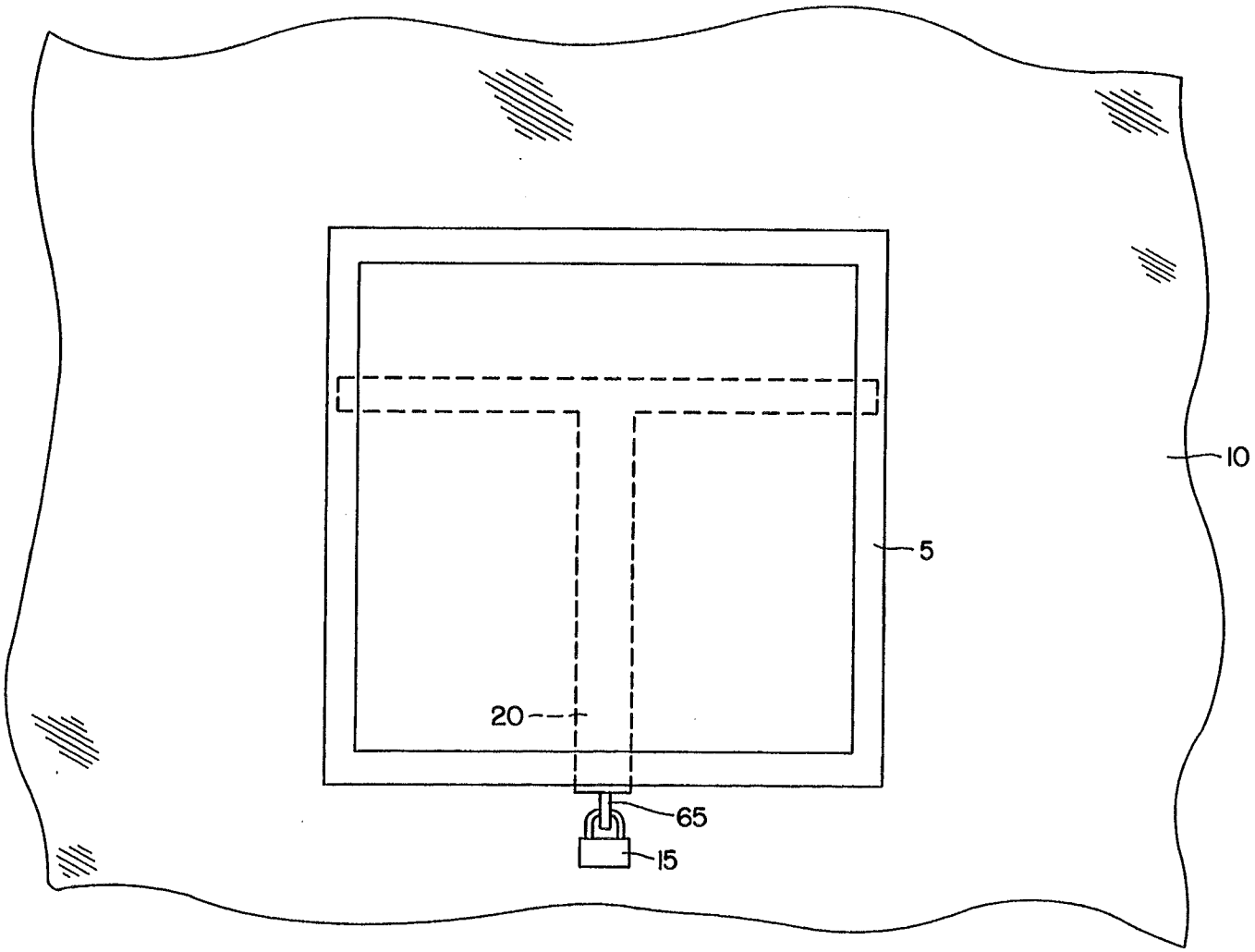
FIG. 1 is a front view of a picture frame mounted and secured to a wall using an embodiment of the present invention.

With reference to the drawings wherein like reference characters represent like components throughout the various views, and with particular reference to FIG. 1, there is depicted a picture frame 5 mounted to a wall 10 by means which will be explained in greater detail below. The picture frame 5 is secured to the wall 10 by a padlock 15. The means for securing via the padlock 15 will also be explained in greater detail below.

Figure 2:
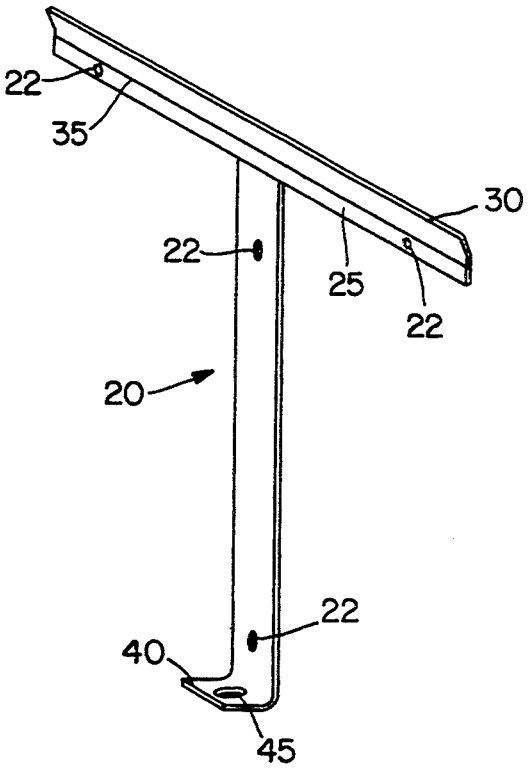
FIG. 2 is a perspective view of a first bracket of the present invention, the first bracket attachable to a wall.

Referring now to FIG. 2, a first bracket 20 is depicted. The bracket 20 is formed in the shape of a "T". Several holes 22 are provided in the bracket 20 for securing the bracket 20 to the wall 10. Screws or other such fasteners (not shown) may be used to fasten the bracket 20 to the wall 10.

The upper portion 25 of the bracket 20 is formed with an upward and outwardly inclined lip 30. The lip 30 is positioned such that when the bracket 20 is secured to the wall 10, the lip 30 is inclined away from the surface of the wall 10 as is depicted more clearly in FIGS. 6 and 7. If the bracket 20 is made of metal, the lip 30 may be formed by bending the upper portion 25 along a line 35. If the bracket 20 is made of a plastic material or other non-metallic material, the lip 30 may be molded during the manufacturing process.

An outwardly extending flange 40 is formed at the lower end of the bracket 20. The flange is provided with an aperture 45 whose purpose will be explained below.

Figure 3:
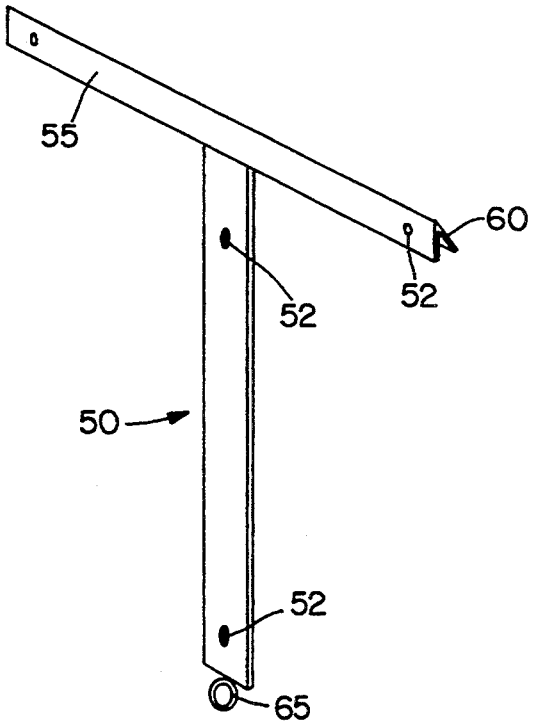
FIG. 3 is a perspective view of a first embodiment of a second bracket that is attachable to a picture frame (but is shown removed from the picture frame) and configured to inter-engage the first bracket.

Referring now to FIG. 3, a second bracket 50 is depicted. A plurality of holes 52 are formed in the bracket 50 for securing the bracket 50 to the picture frame 5. The bracket 50 has a "T" shape similar to the bracket 20. The upper portion 55 of the bracket 50 is formed with an outward and downwardly inclined lip 60 that extends horizontally the length of the upper portion 55 of the bracket 50. At its lower end, the bracket 50 is provided with an eyelet 65 into which the padlock 15 may be placed, as will be explained below.

Figure 4:
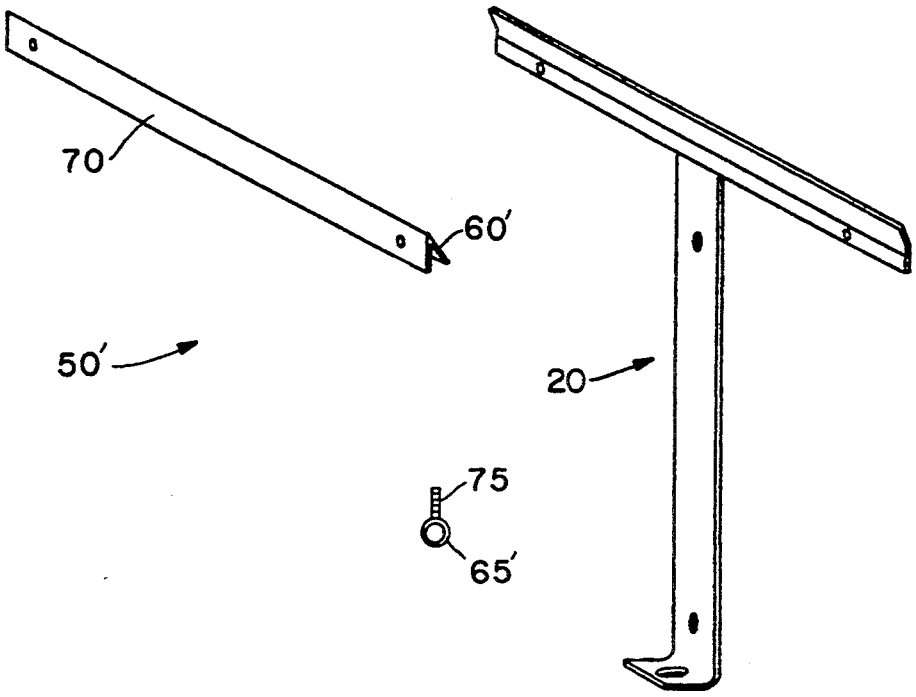
FIG. 4 is a perspective view similar to a combination of FIGS. 2 and 3, depicting a second embodiment of the second bracket wherein the second bracket includes two parts, both parts attachable to a picture frame, the first part being an elongated strip having a downwardly extending lip, the second part having an eyelet and a threaded portion.

Referring now to FIG. 4, an alternate embodiment of the second bracket 50' is depicted alongside the previously described first bracket 20. In the alternate embodiment, the bracket 50 may have two parts. The first part includes a flat horizontal piece 70 having a downwardly extending lip 60' that extends the length of the piece 70. The second part includes an eyelet 65' having a threaded screw portion 75 which may be screwed into the frame 5.

Figure 5:
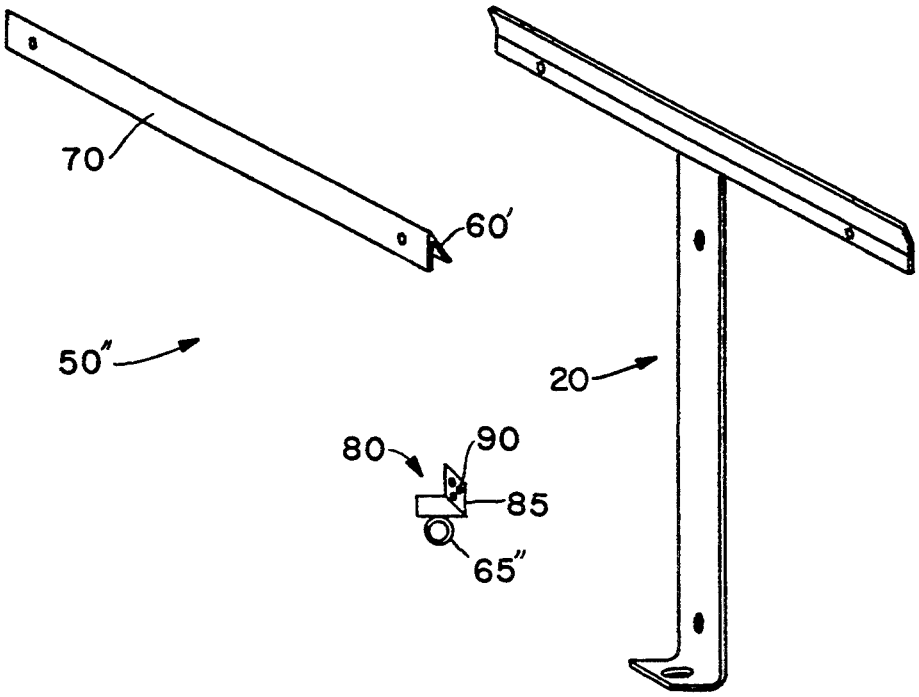
FIG. 5 is a perspective view similar to FIG. 4, depicting yet another embodiment of the invention wherein the second part of the second bracket includes an angled portion having an eyelet attached thereto.

Referring now to FIG. 5, yet another embodiment of the second bracket 50" is depicted. In this embodiment, the bracket 50" again has two parts, the first piece 70 generally the same as the previous embodiment depicted in FIG. 4. The second piece 80 has an eyelet 65" attached to an angled piece 85. The piece 85 is provided with a plurality of holes 90 for attaching the piece 85 to the bottom of the picture frame 5.

Figure 6:
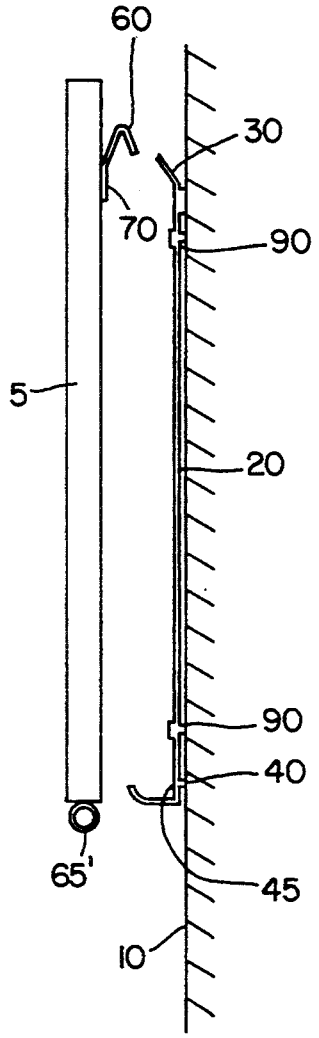
FIG. 6 is a side view of the embodiment depicted in FIG. 4, wherein the first bracket is attached to a wall and both parts of the second bracket are attached to a picture frame, where the two brackets are in close proximity to one another but not engaged with one another.
Figure 7:
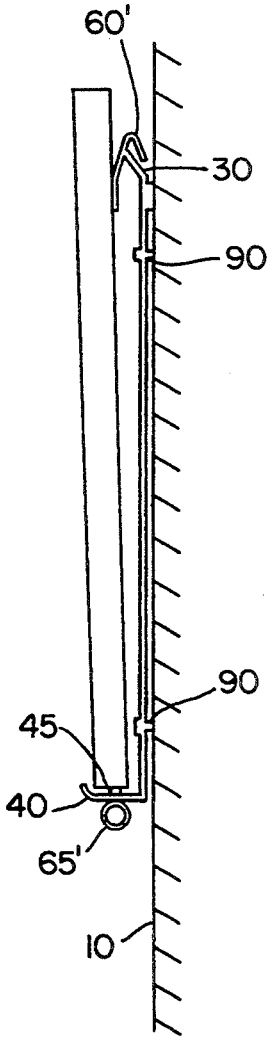
FIG. 7 is a side view similar to the view in FIG. 6 wherein the two brackets are engaged with one another, ready for the insertion of a padlock or like device.

Looking now at FIGS. 6 and 7, the interaction and engagement of the two bracket 50' and 20 are depicted. FIGS. 6 and 7 depict the embodiment shown in FIG. 4, however it should be understood that the function of each of the three embodiments of the second bracket are consistent with the following description. In FIG. 6, the bracket 20 is shown secured to a wall 10 by the screws 90. The bracket part 70 is attached to the frame 5 by screws (not depicted). The eyelet 65' is secured to the bottom of the frame 5 via the threaded portion 75 (see FIG. 4). The frame 5 is positioned proximate the wall 10 so that the lip 60' is near the lip 30. The eyelet 65' is positioned near the flange 40 and the aperture 45. As is shown in FIG. 7, the eyelet 65' extends through the aperture 45, and the lips 30 and 70 engage to mount the picture frame 5 to the wall 10. As is shown in FIG. 1, after mounting, a padlock 15 extends through the eyelet 65' to secure the picture frame 5 to the wall 10 to prevent vandalism of theft.

While the invention has been described in conjunction with various preferred embodiments thereof, it will be understood that it is capable of further modifications. The claims are intended to cover any variation, uses of adaptations of the invention following, in general, the principles of the invention, and including such departures from the present invention as come within known and customary practice within the art to which the invention pertains.

What is claimed is:

1. A securing device mounting and securing a picture frame, plaque, picture, or memorabilia to a wall comprising:

a first "T" shaped bracket having an upwardly inclined lip formed on its upper edge and an outwardly extending flange formed at its lower end, said flange having an aperture formed therein, said first bracket being mountable to a wall; and a second "T" shaped bracket mounted to the back of a picture frame, plaque, picture, or memorabilia said bracket having a downwardly inclined lip formed at its upper edge and an eyelet formed at its lower end, said downwardly inclined lip being engagable with said upwardly inclined lip Of said first bracket and said eyelet insertable through the aperture in said flange.

2. A securing device mounting and securing a picture frame, plaque, picture, or memorabilia to a wall comprising:

a first "T" shaped bracket having an upwardly inclined lip formed on its upper edge and an outwardly extending flange formed at its lower end, said flange having an aperture formed therein, said first bracket being mountable to a wall;

a second bracket mounted to the back of a picture frame, plaque, picture, or memorabilia said bracket having a downwardly inclined lip formed at its upper edge, said lip being engagable with said upwardly inclined lip of said first bracket; and an eyelet member mounted to the bottom of the picture frame, plaque, picture, or memorabilia said eyelet being sized to fit through the aperture in said outwardly extending flange such that the picture frame, plaque, picture or memorabilia may be secured to a wall.

3. A securing device as set forth in claim 2 wherein said eyelet member is formed with a threaded shank which is threaded into the bottom of the picture frame plaque, picture, of memorabilia.

* * * * *